US005234102A

United States Patent [19]

Schuster et al.

[11] Patent Number: 5,234,102

[45] Date of Patent: Aug. 10, 1993

[54] CARRIER FOR STACKED ARTICLES

[75] Inventors: Richard L. Schuster, Monroe, La.; Joseph A. Borocz, Marietta, Ga.

[73] Assignee: Riverwood International Corporation, Atlanta, Ga.

[21] Appl. No.: 991,621

[22] Filed: Dec. 16, 1992

Related U.S. Application Data

[63] Continuation of Ser. No. 834,892, Feb. 11, 1992, abandoned.

[51] Int. Cl.[5] ..... B65D 75/00

[52] U.S. Cl. ..... 206/141; 206/428; 206/430; 229/117.13; 229/117.17

[58] Field of Search ..... 206/139, 141, 162, 427, 206/430, 428; 229/117.13, 117.16, 117.17, 117.12; 493/88, 89

[56] References Cited

U.S. PATENT DOCUMENTS

| | | | |
|---|---|---|---|
| 1,469,797 | 10/1920 | Leslie | 206/430 |
| 1,850,714 | 3/1932 | Gaylord | 206/430 |
| 2,124,808 | 7/1938 | White et al. | 206/430 |
| 2,874,869 | 2/1959 | Hennessey | 206/430 |
| 3,994,432 | 11/1976 | Kirby, Jr. | 206/141 |
| 4,121,757 | 10/1978 | Hamlin | 229/117.13 |
| 4,331,289 | 5/1982 | Killy | 206/141 |
| 4,478,334 | 10/1984 | Graser | 206/141 |
| 4,546,914 | 10/1985 | Roccaforte | 206/141 |
| 4,588,084 | 5/1986 | Holley, Jr. | 206/427 |
| 4,785,991 | 11/1988 | Schuster | 206/141 |
| 4,816,014 | 3/1989 | Bratton et al. | 493/88 |
| 4,830,267 | 5/1989 | Wilson | 206/141 |
| 4,846,395 | 7/1989 | Marquis | 206/141 |

*Primary Examiner*—David T. Fidei

[57] ABSTRACT

A carrier containing a plurality of layers of articles arranged in stacked end-to-end fashion. The carrier is fully enclosed and is formed with overlapping top panel flaps which produce an area of double thickness between handle openings in the flaps. A reinforcing sheet on the underside of the top panel in the double layer area protects against tearing, while stress relief lines in the form of score lines extending from the ends of the handle opening to the corners of the carrier provide for distribution of lifting and carrying stresses.

4 Claims, 3 Drawing Sheets

CARRIER FOR STACKED ARTICLES

This is a continuation, of application Ser. No. 07/834,892, filed Feb. 11, 1992 now abandoned.

FIELD OF THE INVENTION

This invention relates to carriers which are adapted to carry a plurality of articles. More particularly, it relates to a carrier which is adapted to carry a plurality of layers of articles in stacked end-to-end relationship.

BACKGROUND OF THE INVENTION

Sleeve-type carriers are commonly used to package beverage cans and other types of articles, and are typically formed from paperboard blanks which have been folded into collapsed sleeve form. Each collapsed sleeve is opened by a packaging machine, after which cans or other articles are introduced through one or both of the open ends of the sleeve and the end panel flaps are folded and secured together. The cans are normally introduced in upright position while the carrier sleeve is supported on one of its side panels, with the open ends of the sleeve facing out to receive the cans. The resulting carrier therefore contains a layer of cans the ends of which are located adjacent the side panels of the carrier. Additionally, a handle is normally incorporated into the top panel of the carrier to facilitate lifting and carrying.

Although such carriers have been designed to contain varying numbers of articles, conventional packages for carrying beverage cans normally hold six or twelve cans. This is partly because a conventional sleeve-type carrier would be quite long when made large enough to handle large numbers of cans, such as twenty-four, and would be unwieldy to carry. Further, the heavy load caused by the cans would tend to promote tearing in the handle area.

Since it would be highly advantageous to have a sleeve-type carrier capable of holding a large number of articles, and capable of resisting tearing when lifted and carried, it is an object of the invention to provide such a carrier.

BRIEF SUMMARY OF THE INVENTION

The carrier of the invention, which achieves the goal set out above, is designed to receive a plurality of layers of stacked articles. Thus, instead of the usual single layer of articles arranged with their ends adjacent the side panels of the carrier, the invention incorporates a plurality of layers of articles, with the ends of the articles in one layer being adjacent the ends of the articles in the next layer. Moreover, the ends of the articles in the end layers are adjacent the top and bottom panels instead of the side panels. This results in the ability to carry more articles by only slightly increasing the overall dimensions of the carrier and lends itself to the use of a carrier handle which is capable of withstanding the increased load.

The top panel of the carrier preferably is comprised of an inner flap connected to the upper edge of one of the side panels along a fold line and an outer flap connected to the upper edge of the other side panel. In a preferred embodiment, each of the inner and outer flaps has an edge remote from the side panels and each flap contains a handle opening spaced from the remote edge thereof. The outer flap overlaps the inner flap to form an area of double thickness extending between the handle openings. The resulting suitcase style handle facilitates carrying the slightly wider package of the invention. Reinforcing means are provided in the area of double thickness for reinforcing the area against tearing, and stress relief lines are provided in the top panel extending outwardly from the handle openings to distribute lifting stresses.

In a preferred embodiment the stress relief lines comprise score lines extending from each handle opening to the nearest side panel, preferably to the corners of the top panel, and the reinforcing means comprises a sheet adhered to one of the top panel flaps, the sheet including a folded edge substantially aligned with a side edge of the handle opening in the outer top panel flap. Further, the end panels are comprised of end flaps foldably connected to the top, bottom and side panels, the end flap connected to the top panel comprising two overlapped flaps segments, whereby the overlapped flaps comprise an extension of the overlapped top panel flaps.

Due to the stacked arrangement of the articles in the carrier, the carrier is of a shape and size which makes lifting by means of the handle a relatively simple task, even though the contents of the carrier may be quite heavy.

These and other features and aspects of the invention, as well as other benefits, will readily be ascertained from the detailed description of the preferred embodiment described below.

Detailed Description of the Preferred Embodiment

Figure 1:
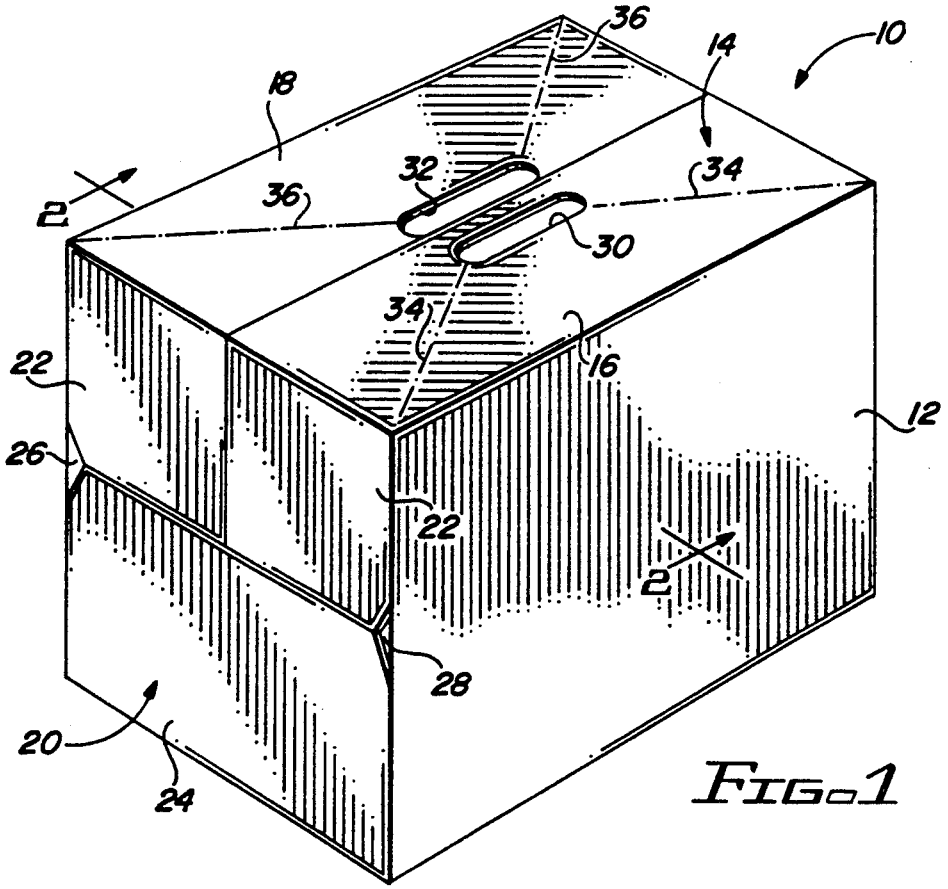
FIG. 1 is a pictorial view of the carrier of the invention.

Referring to FIG. 1 of the drawing, the carrier 10 is comprised of side panels 12 foldably connected to top panel 14 and to the bottom panel, not visible in this view. The top panel is comprised of two top panel flaps 16 and 18, described more fully below. End panels 20 connect the top, bottom and side panels and are comprised of end panel flaps 22 and 24 adhered to dust flaps 26 and 28, wherein the end panel flaps are foldably connected to the top and bottom panels and the dust flaps are foldably connected to the side panels. Spaced handle openings 30 and 32 are provided in the top panel and extend along the length of the carrier substantially parallel to the side panels. Score lines 34 extend from the ends of handle opening 30 to the nearest corners of the carrier, while score lines 36 extend from the ends of handle opening 32 to the other corners of the carrier.

Figure 2:
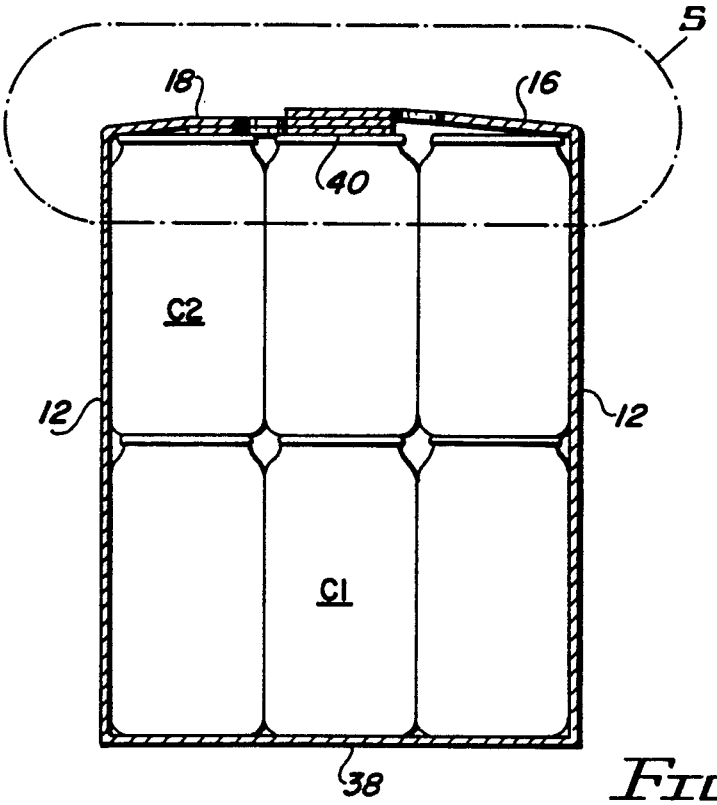
FIG. 2 is a vertical sectional view taken along line 2—2 of FIG. 1.
Figure 3:
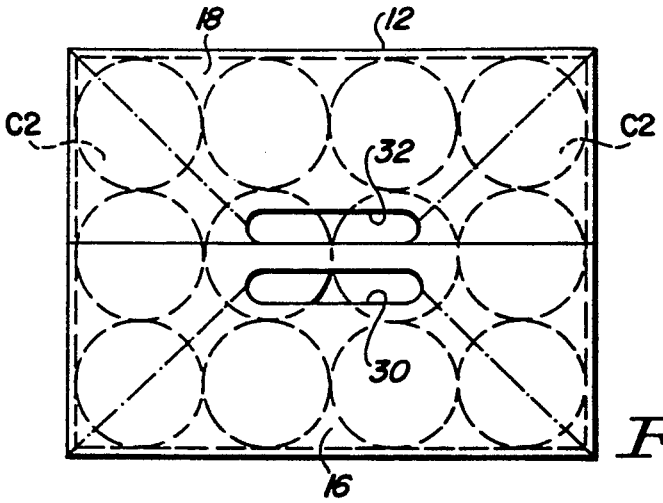
FIG. 3 is a plan view of the carrier of FIG. 1.

As shown in FIGS. 2 and 3, the carrier contains a bottom layer of articles, shown for purpose of illustration as beverage cans C1, and an upper layer of articles, shown as cans C2, in stacked relationship. The lower ends of the upper cans C2 thus are supported on the upper ends of the bottom cans C1, with the bottom cans resting on the bottom panel 38. The top panel 14 is closely adjacent, and preferably is in contact with, the tops of the cans C2 to provide for a tight fit between the cans and the carrier. As shown in FIG. 3, the top layer of cans is made up of twelve cans arranged in three rows of four cans. Since the bottom layer is identically arranged, the total number of cans in the carrier is twenty-four. As illustrated in FIG. 2, the top panel is reinforced between the handle openings as indicated by numeral 40, the details of which are explained hereinafter.

Figure 4:
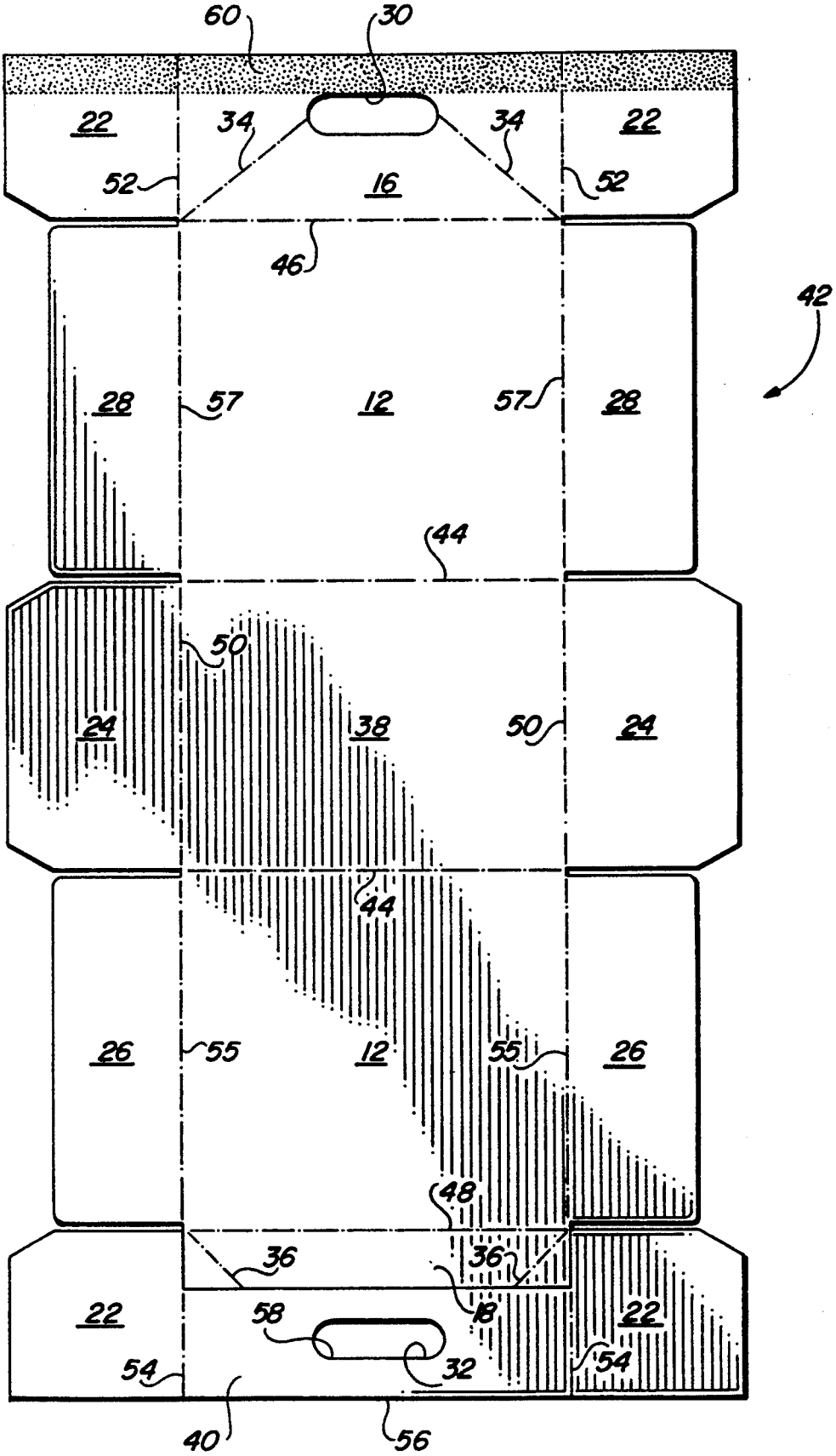
FIG. 4 is a plan view of a blank for fabricating the carrier of FIG. 1.

Referring now to FIG. 4, the carrier 10 of FIG. 1 is formed from the blank 42, wherein portions corresponding to similar elements of the carrier are identified by the same reference numerals. The blank 42 is a single sheet of material, preferably paperboard, comprising a centrally located bottom panel section 38 connected to the side panel sections 12 along fold lines 44. The outer top panel flap 16 is connected to one of the side panel sections 12 along fold line 46, while the inner top panel flap 18 is connected to the other side panel section 12 along fold line 48. End panel flaps 24 are connected to the bottom panel section 38 along fold lines 50, and end panel flaps 22 are connected to the outer and inner top panel flaps 16 and 18 along fold lines 52 and 54, respectively. Inner or dust flaps 26 and 28 are connected to the side panel sections 12 along fold lines 55 and 57, respectively. In addition, the reinforcing means 40 of FIG. 2 comprises a sheet adhered to the inner top panel flap 18 so as to terminate at the free edge 56 of the inner top panel flap. It is preferred that the reinforcing sheet entirely cover the area which includes the handle opening 32, requiring the sheet to have a corresponding cutout 58 to enable the fingers of a user to penetrate the top panel when lifting the carrier, but in any event the sheet should at least extend to the outer edge of the cutout 32 in order to provide extra thickness in the handle strap portion. It will be appreciated that the inner surface of the blank is facing the viewer in FIG. 4 and that the reinforcing sheet is on the inner surface of the inner top panel flap.

Fabrication of the carrier is by standard means, with the blank being folded along the fold lines 44, 46 and 48 to bring the top panel flaps 16 and 18 together and then overlapping and gluing the top panel flaps in the stippled area 60 of the blank of FIG. 4. The end panel flaps 22 extending from the outer top panel flap 16 are thus adhered to the end panel flaps 22 extending from the inner top panel flap 18 to form the upper end panel flaps extending from the top panel. The end panels are formed in the usual manner by first folding the dust flaps 26 and 28 and then the end panel flaps down and gluing the end panel flaps to the dust flaps.

Figure 5:
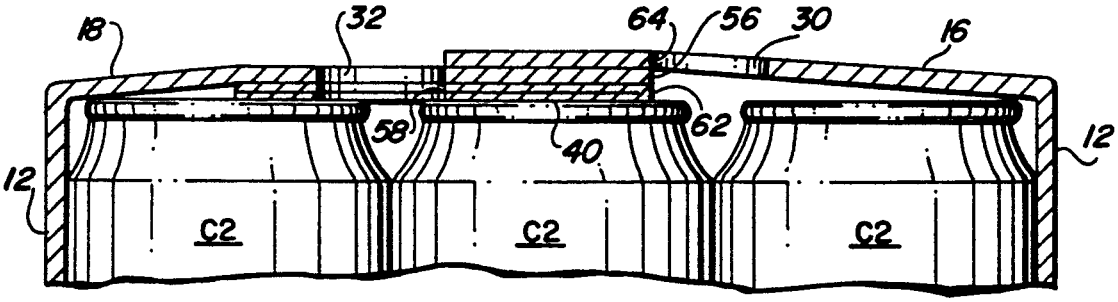
FIG. 5 is an enlarged sectional view of the area enclosed by the oval 5 in FIG. 2.

As shown in FIG. 5, the reinforcing sheet 40 preferably is comprised of a thinner sheet than the material from which the carrier is formed, and is folded over upon itself to provide a fold 62. The fold 62 is aligned with the edge 56 of the inner top panel flap 18, and both are aligned with the inner edge 64 of the cutout 30. This edge is referred to in the claims as the remote side edge of the cutout 30, referring to the arrangement whereby this edge of the cutout is farthest from the side panel to which the inner top panel flap 18 is connected. This design strengthens the strap portion due to the extra thickness of material in this region and also prevents tearing along the cutout edge 64 as well as in areas of the top panel flap 16 which would normally be at risk to a tear originating at this critical juncture in the handle area. This is thought to be due to the fact that a fold acts as a surface rather than an edge, and just as it is considerably more difficult to initiate a tear at a surface than at an edge, the folded reinforcement strip makes it difficult to initiate a tear along this lifting edge of the handle opening. This design additionally provides a cushioning effect for the hand of a user. For purpose of illustration the thickness of the carrier material has been exaggerated. It will be understood, therefore, that in actual practice the thickness of the strap portion of the handle between the openings 30 and 32 will not be as great with respect to the height of the cans as shown, and the top panel flaps 16 and 18 will be in contact with more, if not all, of the top surface of adjacent cans.

Figure 6:
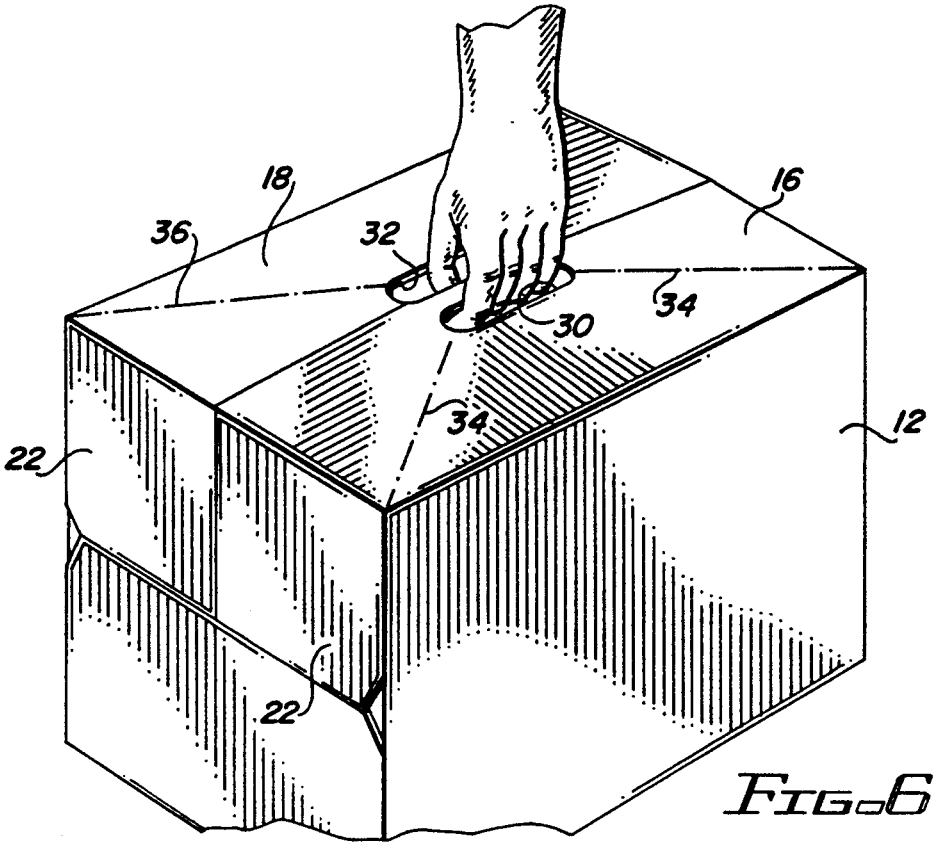
FIG. 6 is a pictorial view of the carrier of the invention illustrating the distortion of the top panel while being lifted or carried.

As will be appreciated, there is little room for the fingers of a user to maneuver when trying to get a grip on the handle strap due to the close proximity of the tops of the cans to the top panel. The design of the invention anticipates upward movement of the top panel as the fingers pull up on the handle while first gripping the strap portion and during lifting and carrying. As shown in FIG. 6, the top panel is adapted to smoothly bow upwardly without tearing at critical areas which normally receive most of the lifting stresses. This is accomplished by the stress relief score lines 34 and 36 which extend from the ends of the handle cutouts to the side panels. Preferably, as illustrated, these lines extend to the corners of the package, thereby transmitting the lifting stresses to the corner folds.

The benefit of the carrier design of the invention can be better understood by comparing a carrier of the invention which is adapted to carry 24 standard 12-fluid ounce beverage cans to a sleeve-type carrier adapted to carry only 12 of the same cans. In the 12-can prior art carrier the cans are arranged with their ends against the side panels in three rows of four cans each. The length of the package is thus approximately equal to four can diameters, the height to three can diameters and the width to one can length. In the 24-can carrier of the invention the cans are arranged with their ends against the top and bottom panels in two stacked layers, each layer being made up of three rows of four cans each. The length of this package is thus approximately equal to four can diameters, the same as the length of the prior art 12-can package. The height of the package is approximately equal to two can lengths and the width of the package is approximately equal to three can diameters. In terms of actual dimensions, this would mean that for a package of the same length as the prior art 12-pack package, a height of only about two inches more and a width of less than three inches more results in twice the carrying capacity. Additional layers of cans or other articles could be packaged simply by making the height of the carrier an additional article length greater.

The handle reinforcement afforded by the suitcase type of handle illustrated in the preferred embodiment resists tearing in this critical area, and the stress relief lines distribute the lifting and carrying stresses from the handle area to the sides, preferably to the corner folds of the carrier. The overlapped portion of the top panel extends beyond the handle area to the ends of the top panel and beyond the top panel through the upper end panel flaps connected to the top panel. This increases the strength of the end panel flaps which in turn increases the strength of the end panels, allowing them to better resist the lifting stresses which may be distributed to them via the stress relief lines.

Although a specific carrier design has been disclosed which is economical to fabricate and is capable of increasing the carrying capacity over prior art carriers while only slightly increasing the carrier size, it will be understood that changes to certain features and aspects of the design which do not affect the overall basic function and concept of the invention may be made by those skilled in the art without departing from the spirit and scope of the invention, as defined by the appended claims.

What is claimed is:

1. An article carrier containing a plurality of layers of stacked articles, comprising:

two side panels having upper and lower edges;

a bottom panel connected to the lower edges of the side panels;

a top panel connected to the top edges of the side panels;

the top panel being comprised of an inner flap connected to the upper edge of one of the side panels along a fold line and an outer flap connected to the upper edge of the other side panel along a fold line, the top panel including handle means;

end panels connected to the top, bottom and side panels;

the plurality of layers of articles having top and bottom ends, the articles of each layer being arranged in stacked end-to-end relationship with the articles in the next adjacent layer, the bottom ends of the articles in the lowermost layer contacting the bottom panel of the carrier and the top ends of the articles in the uppermost layer being adjacent the top panel of the carrier when the carrier is resting on the bottom panel;

each inner and outer top panel flap having an edge remote from the side panels and each said flap containing a handle opening spaced from the remote edge of said flap, the outer top panel flap overlapping the inner top panel flap to form an area of double thickness, said area extending between the handle openings; and reinforcing means in the area of double thickness for reinforcing said area against tearing, the reinforcing means comprising a sheet adhered to the underside of the inner top panel flap, the sheet including a folded edge substantially aligned with and underlying the edge of the handle opening in the outer top panel flap nearest the remote edge of the outer top panel flap, the sheet being of less thickness than the thickness of the top panel flaps.

2. The carrier of claim 1, wherein each flap of the top panel includes stress relief lines extending from the ends of the handle opening therein to the side panel nearest thereto to distribute lifting stresses outwardly from the handle openings.

3. The carrier of claim 1 wherein each end panel comprises end flaps foldably connected to the top, bottom and side panels, the end flap connected tot he top panel comprising two overlapped flaps, one of the two overlapped flaps extending from the inner top panel flap and the other of the two overlapped flaps extending from the outer top panel flap, the overlapped flaps being adhered together by adhesive.

4. The carrier of claim 1, wherein the articles are beverage cans arranged in two layers, the cans in each layer being arranged in rows parallel to the side panels and rows parallel to the end panels, the number of cans in the rows parallel to the side panels being one more than the number of cans in the rows parallel to the end panels.

* * * * *